US007357759B2

(12) United States Patent
Bonnell

(10) Patent No.: US 7,357,759 B2
(45) Date of Patent: Apr. 15, 2008

(54) EXERCISE DEVICE

(76) Inventor: Loren W. Bonnell, 107 S. Englewood Ave., Tyler, TX (US) 75702

( * ) Notice: Subject to any disclaimer, the term of this patent is extended or adjusted under 35 U.S.C. 154(b) by 645 days.

(21) Appl. No.: 10/865,821

(22) Filed: Jun. 14, 2004

(65) Prior Publication Data

US 2005/0277526 A1 Dec. 15, 2005

(51) Int. Cl.
*A63B 21/00* (2006.01)

(52) U.S. Cl. ..... 482/72; 482/142; 482/121

(58) Field of Classification Search ..... 482/72, 482/142, 121, 126, 130, 140
See application file for complete search history.

(56) References Cited

U.S. PATENT DOCUMENTS 5,542,897 A * 8/1996 Hall ..... 482/111
5,573,485 A 11/1996 Geschwender
5,599,261 A 2/1997 Easley
D392,702 S 3/1998 Sands et al.
5,971,902 A 10/1999 Robertson et al.
6,113,524 A 9/2000 Huang
6,152,866 A * 11/2000 Kuo ..... 482/142
6,220,996 B1 * 4/2001 McArthur ..... 482/142
6,290,630 B1 9/2001 Boland
6,485,398 B1 11/2002 Kreft
6,533,710 B2 * 3/2003 Lin et al. ..... 482/123
6,752,745 B1 * 6/2004 Davis ..... 482/72
2003/0060347 A1 3/2003 Tang

* cited by examiner

*Primary Examiner*—Jerome Donnelly
(74) *Attorney, Agent, or Firm*—Egbert Law Offices

(57) ABSTRACT

An exercise device has a base, an arm pivotally connected to the base, a plate pivotally connected to the base, and a shoulder support affixed adjacent an end of the arm opposite the base. The arm is resiliently interconnected to the base so as to be resistive of forward movement of the arm. The plate is resiliently connected to the base so as to be resistive of movement between a first position resting flat on the base and a second position angled upwardly from the base.

12 Claims, 4 Drawing Sheets

EXERCISE DEVICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to exercise devices. More particularly, the present invention relates to exercise devices for assisting persons with physical limitations in the knee and lower extremities.

BACKGROUND OF THE INVENTION

As daily living shifts from reliance on physically demanding to more sedentary activities, human bodies become susceptible to unfitness. Many persons engage in a regimen of various physical activities, which often include interaction with inanimate objects, such as free weights, and machines, such as stationary bicycles, in order to preserve or regain fitness.

The body has many muscles groups which are responsible for controlling independent body functions. For example, the muscles for extending an arm are independent of muscles for raising a leg. Thus, exercising one muscle group may not exercise another muscle group. Accordingly, to preserve or regain muscle fitness, the body must engage in activities that exercise the muscles groups desired to be fit. However, some muscles groups, the abdominal and oblique muscles groups, in particular, are difficult to condition.

Exercising is very difficult for persons having physical limitations in the knee and lower extremity areas and for those with decreased range of movement. As such, a need has developed for an exercise device that can accommodate these persons and provide an effective exercise workout. For such persons, it important to be able to build and tone the muscle mass around the quads, gluts and knee regions. Additionally, it is also important to improve the muscle tone in the calves, lower abs and muscles in the lumbar area. For such persons, it is important to be able to avoid stress to the knee or supporting joints during the workout.

In the past, various patents have issued relating to exercise devices. For example, U.S. Pat. No. 6,290,630, issued on Sep. 18, 2001 to K. O. Boland, teaches a free-standing physical exercise device. The device includes a ground support frame, a vertical mast secured hingedly to the frame, a slidable position support mechanism mounted on the mast, and a set of hand-grippable levers. A lever support bracket permits the arcuate movement of the lever bars about the support mechanism. A dual-direction resistance means is operatively connected between the lever support bracket and the mast-mounted slidable mechanism so as to provide variable resistance to the arcuate motion of the levers in both directions.

U.S. Pat. No. 6,485,398, issued on Nov. 26, 2002 to P. H. Kreft, describes an exercise device that includes a knee rest which allows leverage against resistance. This device is configured to strength the abdominal and oblique muscles in a relaxed state by kneeling and twisting the lower torso. Handles extend from the base to which the user may comfortably grasp the knees while kneeling on the knee rest. The user exercises by urging the upper torso to rotate the knee rest.

U.S. Pat. No. 6,113,524, issued on Sep. 5, 2000 to C. C. Huang, describes a bridge flex machine which is composed of a first rod, a second rod and two transverse rods mounted between the first and second rods. A triangular block is mounted on the frame and located on the first rod. A U-shaped member is slantingly inserted into the triangular member and fixedly mounted thereon by a bolt. An oscillating rod is pivotally connected with the upper ends of the U-shaped member. The user has his or her feet on the foot support rod and can bend forward so as to push a rectangular frame forward in pivotable relationship to the frame.

U.S. Pat. No. 5,971,902, issued on Oct. 26, 1999 to Robertson et al., shows a lumbar extension machine. This device includes an elongated base frame which has a U-shaped front portion and T-shaped back portion. An inverted Y-shaped, lower support shaft has three members with a rectangular configuration removably attached to the base frame.

U.S. Pat. No. 5,559,261, issued on Feb. 4, 1997 to Easley et al., describes an exercise device with two-way articulation. The device includes a first sub-frame supporting body support members having a foot rest and a seat. A second sub-frame is operably coupled to the first sub-frame by a joint having two axes of rotation and internal stops for controlling the rotation about both axes. A backrest is carried by the second sub-frame. Elastomeric resistant elements are selectively and operably coupled across the joint.

U.S. Pat. No. 5,573,485, issued on Nov. 12, 1996 to R. C. Geschwender, describes an exercising and strengthening apparatus which manipulates the back in a manner intended to strengthen back muscles and maintain spine flexibility. Adjacent arrays of rollers are mounted on in a frame in a manner that allows the arrays of roller to be secured in a first position relative to one another. An adjacent pair of rollers are coaxially aligned in a second position relative to one another.

U.S. Patent Application Publication No. U.S. 2003/0060347, published on Mar. 27, 2003 to J. Tang, describes an abdominal exercising machine constructed to include a base formed of a first frame and a second frame axially adjustable therewith. A footplate is mounted on the second frame of the top of the resting of the user's feet. A seat is fixedly mounted on the first frame. The device further includes a back support having a first supporting frame pivotably connected to the first frame and holding a lower back cushion. A second supporting frame is hingedly connected to the first supporting frame in order to hold an upper back cushion. Two handle bars symmetrically extend from the second supporting frame. A damping device is coupled between the supporting frame of the back support and the first frame of the machine base.

U.S. Design Pat. No. 392,702, issued on Mar. 24, 1998 to Sands et al., illustrates a swimming exercise device having arms extending outwardly of a torso support section and foot plates extending outwardly in the same direction as the arms.

It is an object of the present invention to provide an exercise device that can assist persons with physical limitations in the knees and lower extremities and assist persons with decreased range of movement.

It is another object of the present invention to provide an exercise device which builds and tones the muscle mass around the quads, gluts, and knee regions.

It is a further object of the present invention to provide an exercise device that provides exercise to the calves, lower abs and muscles in the lumbar area.

It is a further object of the present invention to provide an exercise device which avoids stress to the knee or supporting joints during the workout.

It is a further object of the present invention to provide an exercise device which is easy to use, easy to assemble, easy to manufacture and relatively inexpensive.

These and other objects and advantages of the present invention will become apparent from a reading of the attached specification and appended claims.

BRIEF SUMMARY OF THE INVENTION

The present invention is an exercise device comprising a base, an arm pivotally connected to the base, a plate pivotally connected to the base, and a shoulder support affixed to an end of the arm opposite the base. The arm is resiliently interconnected to the base so as to be resistive of forward movement of the arm. The plate is movable between a first position resting on the base and a second position angled upwardly from the base such that the upper end of the plate in the second position faces the arm. The shoulder support extends inwardly from the arm in a direction toward the plate.

In the present invention, the arm is movable between a first position inwardly of the base and second position outwardly of the base.

In the present invention, a foot support is connected to the base and extends outwardly of the plate on a side of the plate opposite the arm. The foot support has a pair of foot plates pivotally supported thereon. The foot support is suitably extendable in a desired direction outwardly from the base rearwardly of the plate. The device of the present invention has a spring support extending upwardly from the base in an area between the arm and the plate. A spring extends from the spring support and is connected to the arm. The spring provides resilient interconnection between the arm and the base. The spring support specifically is a housing mounted on a rod. The rod extends upwardly from the base. The housing is affixed to the rod. The housing has an angled portion and a vertical portion. A strut has one end affixed to the housing and an opposite end connected to the base forward of the rod so as to provide structural integrity to the spring support. A bracket is adjustably affixed to the arm at an location between the shoulder support and the base. This spring has one end affixed to the bracket.

The shoulder support of the present invention specifically includes a shoulder bracket affixed adjacent to the end of the arm opposite the base. A first shoulder pad extends outwardly of the shoulder bracket in the direction toward the plate. A second shoulder pad extends outwardly of the shoulder bracket in the direction toward the plate. The first shoulder pad is in spaced parallel relationship to the second shoulder pad. The shoulder support further includes a first handle extending angularly outwardly adjacent a forward end of the first shoulder pad. A second handle extends angularly outwardly adjacent a forward end of the second shoulder pad. Each of the first and second shoulder pads are angularly adjustable with respect to the shoulder bracket. A channel member is affixed to the shoulder bracket and extends transverse to the arm. A first shoulder support member is adjustably received within the channel member. A second shoulder support member is adjustably received in an opposite end of the channel member. A first lock member is connected to the channel member and to the first shoulder support member. A second lock member is connected to the channel member and to the second shoulder support member. The first and second lock members serve to lock a position of the first shoulder pad relative to the second shoulder pad.

In the present invention, the plate is hingedly connected at an end thereof opposite the arm to the base. A spring has one end affixed to the frame and an opposite end connected to the plate. The spring is resistive of movement of the plate from the first position to the second position. A pad is affixed to the top surface of the plate. The pad has a top surface angled upwardly from the end of the plate toward an opposite end of the plate. The plate extends beyond an end of the pad.

The base of the present invention includes a first bar, a second bar, and at least one cross member affixed to and extending between the first bar and the second bar. A central bar is positioned in generally parallel spaced relationship between the first bar and the second bar. The arm is pivotally connected to the second bar. The cross member extends across an end of the first and second bars opposite the pivotal connection with central bar. A pair of wheels are affixed to the cross member and extend therebelow. A plurality of legs extend downwardly from the first and second bars so as to support the base upon an underlying surface.

DETAILED DESCRIPTION OF THE INVENTION

Figure 1:
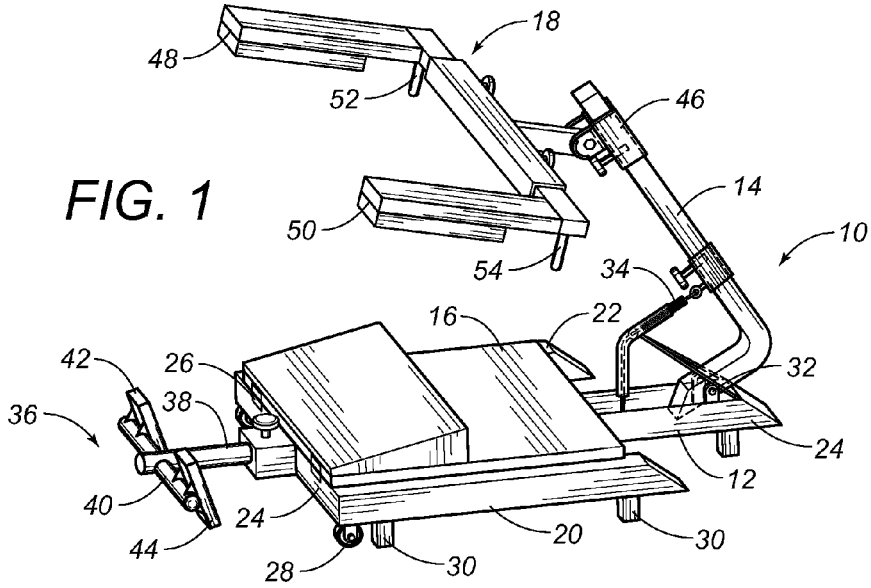
FIG. 1 is a perspective view of the exercise device of the present invention.

Referring to FIG. 1, there is shown the exercise device 10 in accordance with preferred embodiment of the present invention. The exercise device 10 includes a base 12, an arm 14 pivotably connected to the base, a plate 16 pivotably connected to the base, and a shoulder support 18 that is affixed adjacent to an end of the arm 14 opposite the base 12. The arm 14 is resiliently connected to the base 12 so as to be resistive of forward movement of the arm 14. The plate 16 is pivotably connected to the base 12 so as to be moveable between a first position (illustrated in FIG. 1) to a second position (illustrated in FIG. 6). The shoulder support 18 extends inwardly from the arm 14 in a direction toward the plate 16.

In FIG. 1, the base 12 includes a first bar 20, a second bar 22 and a central bar 24 positioned in spaced parallel relationship between the first bar 20 and the second bar 22. A cross member 24 extends between the first bar 20, the second bar 22 and the central bar 24 at the rear of the base 12. The plate 16 is pivotally connected by hinges 26 to the cross member 24 at the rear at the base 12. The plate 16 will rest in a generally flat horizontal orientation upon a top surface of the first bar 20, the second bar 22 and the central bar 24 when in the first position. A pair of wheels 28 extend downwardly from the cross member 24 at the rear of the base 12. The wheels 28 allow the device 10 to be rolled and positioned upon a surface. Legs 30 extend downwardly from the first bar 20 and the second bar 22 so as to support the base 12 upon an underlying surface.

Figure 11:
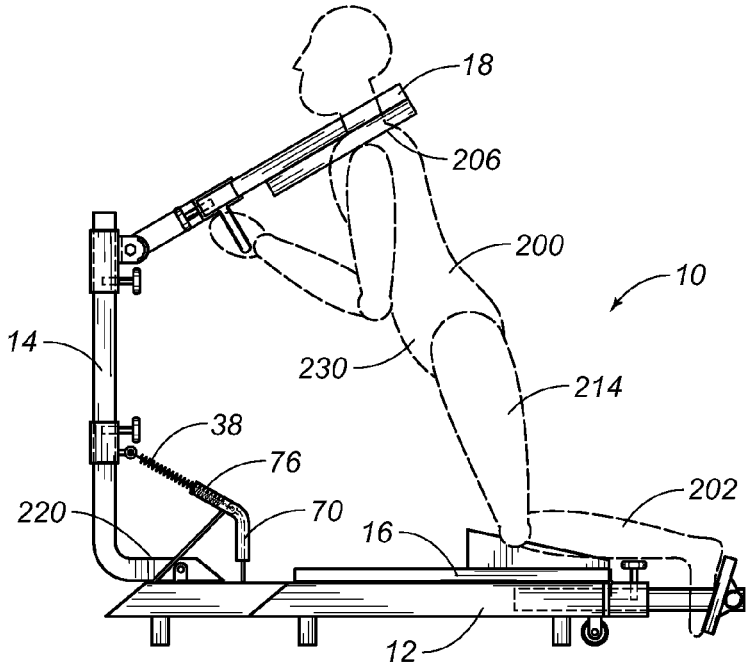
FIG. 11 is a side elevation view of the exercise device of the present invention in a 140° knee plate-to-full extension position.

The arm 14 is pivotally connected to a pivot bracket 32 on the central bar 24 of base 12. The arm 14 is curved so as to extend outwardly and then back inwardly. A spring 34 is suitably interconnected to the base 12 so as to be resistive of forward movement of the arm 14. As will be described hereinafter, the arm 14 is pivotable about pivot support 32 so as to move from an inward position (shown in FIG. 1) to an outward position (as shown in FIG. 11).

A foot support 36 is connected to the base 12 and extends outwardly of the plate 16 on a side of the plate opposite the arm 14. Specifically, the foot support 36 includes a tubular member 38 that is slidably received within an end of the central bar 24 opposite the arm 14. As will be described in FIG. 5, the position of the inner tube 38 can be suitably adjusted so as to fit the size of the user of the exercise device 10. A cross bar 40 is affixed to the tubular member 38 and extends transversely thereto. Cross bar 40 supports foot plate 42 and 44 pivotally thereon. This pivotal connection is illustrated in greater detail in association with FIG. 5.

The shoulder support 18 includes a shoulder bracket 46 affixed adjacent to an end of the arm 14 opposite the base 12. A first shoulder pad 48 extends outwardly of the shoulder bracket 46 in a direction toward the plate 16. A second shoulder pad 50 extends outwardly of the shoulder bracket 46 in a direction toward the plate 16. The first shoulder pad 48 is in spaced parallel relationship to the second shoulder pad 50. A first handle 52 extends angularly outwardly adjacent the forward end of the first shoulder pad 48. A second handle 54 extends angularly outwardly adjacent the forward end of the second shoulder pad 50. As will be described hereinafter in association w FIGS. 7 and 8, the shoulder pads 48 and 50 are angularly adjustable with respect to the shoulder bracket 46.

Figure 2:
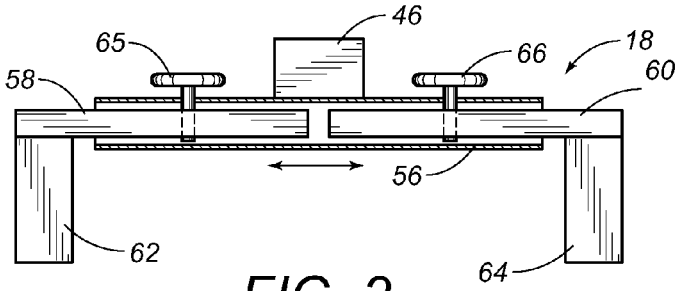
FIG. 2 is a cross-sectional view showing the shoulder support members of the present invention.

FIG. 2 is an isolated view showing the adjustability of the shoulder support 18. In particular, a channel member 56 is affixed to the shoulder bracket 46. Channel member 56 is a tubular member having a channel extending therethrough. A first shoulder support member 58 is slidably received within the channel member 56 at one end of the channel member 56. A second shoulder support member 60 is slidably received within the interior of channel member 58 at an opposite end from that of shoulder support member 58. An arm 62 extends transversely outwardly of the first shoulder support member 58. Arm 64 extends transversely outwardly to the second shoulder support member 60. A locking member 65 (in the form of a pin connector) is connected between the channel member 56 and the first shoulder support member 58 so as to fix a position of the shoulder support member 58 within the channel of channel member 56. Another locking member 66 is connected between the channel member 56 and the second shoulder support member 60 so as to fix a longitudinal position of the second shoulder support member 60 within the channel member 56. As a result, the distance between the shoulder pads 48 and 50 can be suitably adjusted.

Figure 3:
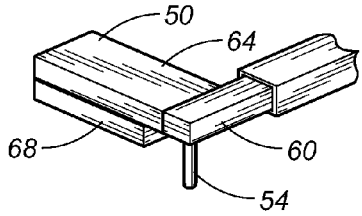
FIG. 3 is an isolated view showing the shoulder pad of the present invention.

FIG. 3 is a detailed view showing the shoulder pad 50. As can be seen, the arm 54 extends transverse outwardly of the second shoulder support member 60. A pad 68 is affixed to the underside of the arm 64 so as to provide a soft surface upon which the user can present his or her shoulder. The handle 54 is shown as extending angularly outwardly on an underside of the second shoulder support member 60.

Figure 4:
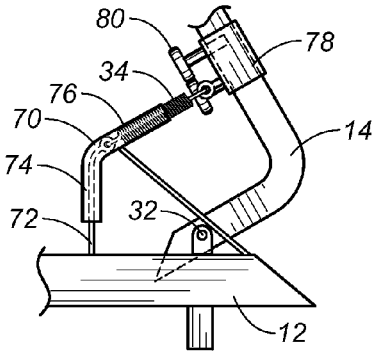
FIG. 4 is a detailed view showing the resilient connection between the arm and the base of the present invention.

FIG. 4 illustrates the manner in which the spring 34 is secured so as to be resistive of forward movement of the arm 14 about pivot support 32 on the base 12. Importantly, a housing 70 is affixed to a rod 72 extending upwardly from the base 12. Housing 70 includes a vertical portion 74 and an outwardly angled portion 76. The spring 34 is housed within the outwardly angled portion 76 of housing 70. One end of the spring 34 is affixed within the housing 70. The opposite end of the spring 34 is connected to a bracket 78 which is adjustably affixed to the arm 14 in a location between the shoulder support 18 and the base 12. The spring 34 has one end connected to the bracket 78. A pin connector 80 serves to lock a position of the bracket 78 along the length of the arm 14.

Figure 5:
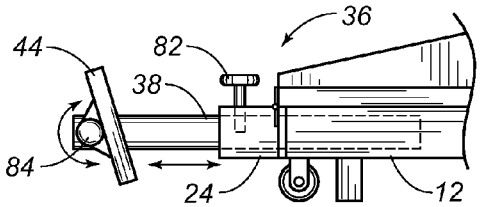
FIG. 5 is a detailed view showing the pivotal connection between the foot plate and the foot support.

FIG. 5 illustrates the foot support 36 located at the rear end of the base 12. It can be seen that the tubular member 38 is slidably received within the channel defined by the central bar 24. A locking member 82 suitably engages the tubular member 38 (through the holes, slots, or other devices) so as to fix an outward position of the tubular member 38 relative to the central bar 24. The foot plate 44 is freely pivotally supported about axle 84 at the end of the tubular member 38. As a result, the foot plate 44 can suitably pivot relative to the angular position of the legs of the user as the plate 16 tilts upwardly and/or downwardly.

Figure 6:
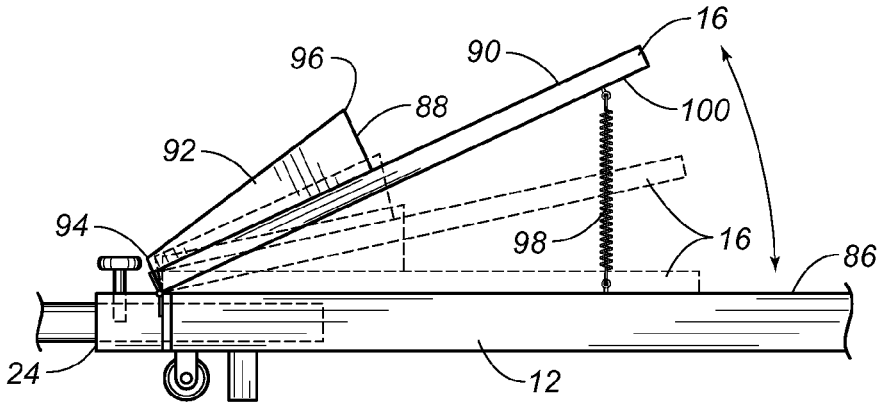
FIG. 6 is a side elevational view showing the various positions of the plate in it angular movement relative to the base.

FIG. 6 is a detailed illustration of the plate 16 as pivotally supported upon the base 12. The plate 16 is initially illustrated as laying flat upon the top surface 86 of the base 12. The plate 16 will be movable up to a second position extending angularly upwardly from the top surface 86 of base 12. A knee pad 88 is affixed to the top surface 90 of the plate 16 so as to provide cushion and support for the legs of the user. The pad 88 has an angled top surface 92 that increases in height from the rear 94 of plate 16 toward the opposite end of plate 16. As can be seen, the plate 16 extends outwardly beyond the forward end 96 of the pad 92. The configuration of the pad 92, as illustrated in FIG. 6, is desirable because it minimizes any pressure upon the knees of the user. The knees of the user can rest comfortably outwardly beyond the forward end 96 of the pad 92. As a result, the angular movement of the plate 16 will not present discomfort or stress upon the user's knees.

In FIG. 6, it can be seen that the plate 16 has a continuously variable position between the first position lying flat on the top surface 86 of plate 16 and the second position angled upwardly therefrom. A spring 98 has one end connected to the underside 100 of the plate 16 and an opposite end affixed to the top surface 86 of the base 12. As a result, the spring will be resistive of movement of the plate 16 between the first position and the second position. A suitable hinge (not shown) can be affixed to the cross member 24 at the rear of base 12 so as to allow for the angular pivotal movement of the plate 16.

Figure 7:
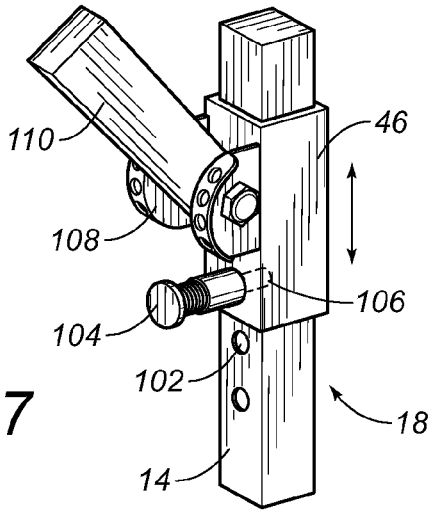
FIG. 7 is a detailed view showing the adjustability of the location of the shoulder support relative to the arm.

FIG. 7 shows how the shoulder support 18 can be adjusted for height along the arm 14. The arm 14 has a plurality of holes 102 formed in spaced positions along the length of the arm. A pin-type connector 104 is spring-loaded on bracket 46. When the bracket 46 slides to a position in which the pin connector 104 aligns with a hole 102, the pin connector 104 can be released so that the end 106 of pin connector 104 engages the hole 102. As such, the bracket 46 will be positioned in a desired location along the length of the arm 14. An angle control mechanism 108 is affixed to the bracket 46 and extends inwardly therefrom. An arm 110 is adjustably received within the angle control mechanism 108 so as to extend to the channel member 56.

Figure 8:
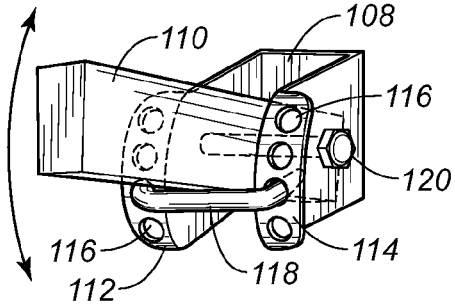
FIG. 8 is a detailed illustration showing how the shoulder support can be angularly adjustable relative to the arm.

FIG. 8 shows the manner in which the angular position of the arm 110 can be controlled within the angle control mechanism 108. In particular, the forward flanged surfaces 112 and 114 of the angle control mechanism 108 have a plurality of holes 116 formed therein. A locking member 118 has suitable pins that are received in respective holes 116 across the flanged surfaces 112 and 114. As a result of a desired positioning of the locking member 118, the angular position of the arm 110 can be locked into the position with respect to pivot point 120. The shoulder pads 48 and 50 can be locked into a desired angular position to fit the size, location and desires of the user.

Figure 9:
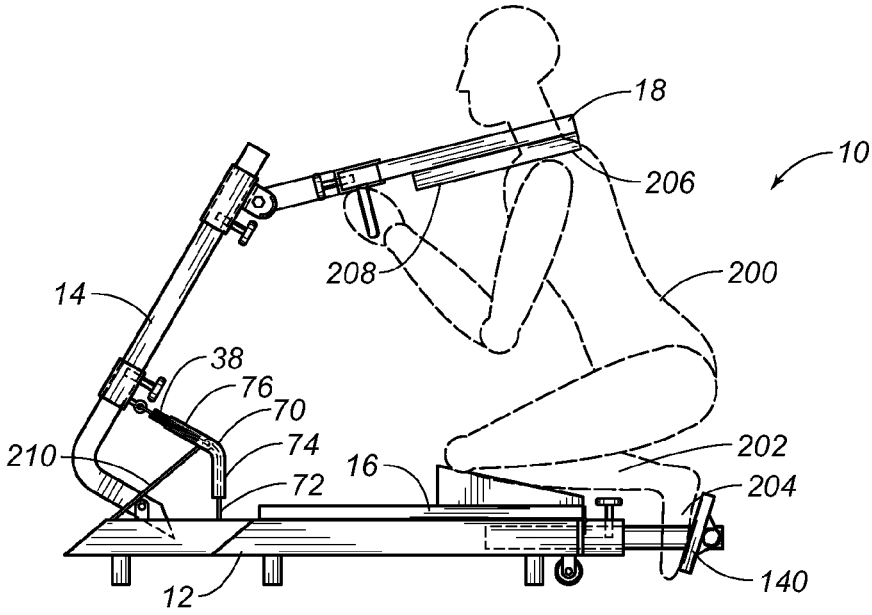
FIG. 9 is a side elevation view showing the exercise of the present invention in a 140° knee flexion start position.

FIG. 9 shows the use of the device 10 of the present invention in a 140° knee flexion start position. As can be seen, the user 200 will kneel so that his or her lower legs 202 rest upon the plate 16 (or the pad positioned thereon). The feet 204 of user 200 will rest upon the foot support 40. The plate 16 is laying flat upon the top surface of the base 12. The shoulders 206 of user 200 are positioned on the underside 208 of the shoulder support 18. The arm 14 is pivoted inwardly toward the plate 16 so as to be in the non-resistive home position. Spring 34 causes the arm 14 to be in this home position. The user 200 can suitably adjust the shoulder support 18 to the desired inclination, spacing and angle.

In FIG. 9, it should be noted that the housing 70 is illustrated as having the vertical portion and the outwardly angled portion 76. Rod 72 supports the housing above the base 12. A strut 210 will extend from the housing 70 to the base 12 so as to provide strength and resistance when the arm 14 resistively moves outwardly from the position illustrated in FIG. 9. As a result, strut 210 will enhance the structural integrity of the housing 70.

Figure 10:
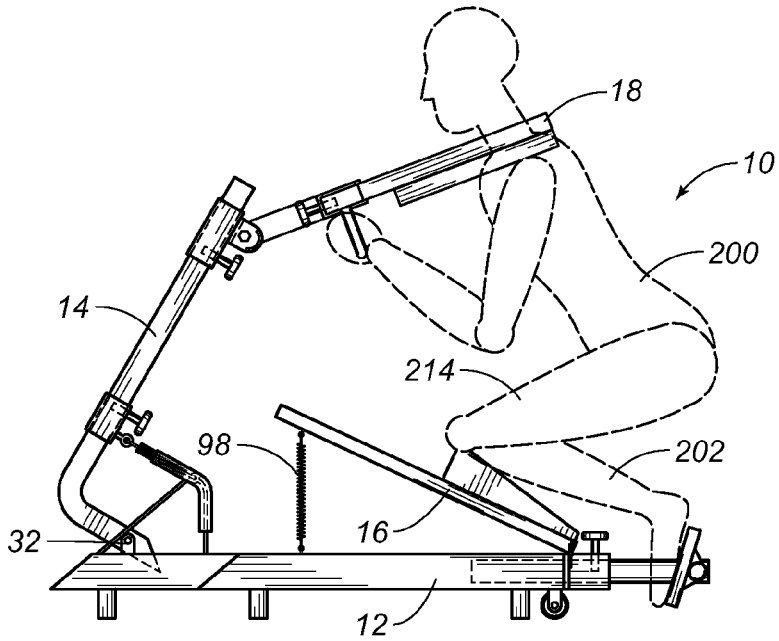
FIG. 10 is a side elevation view of the exercise device of the present invention showing in a 90° knee plate start position.

FIG. 10 illustrates the device 10 in the 90° knee plate start position. As can be seen, the bower legs 202 form an approximately 90° angle with the upper legs 214 of the user 200. The plate 16 is angled upwardly off the base 12. The upward movement of the plate 16 is resisted through the use of the spring 98. The shoulder support 18 is slightly elevated upwardly while the arm 14 moves slightly outwardly about the pivot point 32.

FIG. 11 shows a 140° knee plate-to-full extension position of the user 200 on the device 10 of the present invention. In this position, the plate 16 rests upon the top surface of the base 12. An approximately 140° angle is formed between the lower legs 202 and the upper legs 214 of the user 200. The arm 14 is in its fully extended outward position. The lower portion 220 of the arm 14 resides in a generally flat orientation upon the top surface of the base 12. Spring 38 is in its fully extended position. The shoulders 206 of the user abut the underside of the shoulder pads 18 in an outward position. It should be noted that the abdomen 230 of the user 200 comes in close proximity to the outwardly angled surface 76 of housing 70. The outer surface 76 of the housing 70 provides a cushioning effect when the user's abdomen 230 approaches such a surface in the fully extended position.

Figure 12:
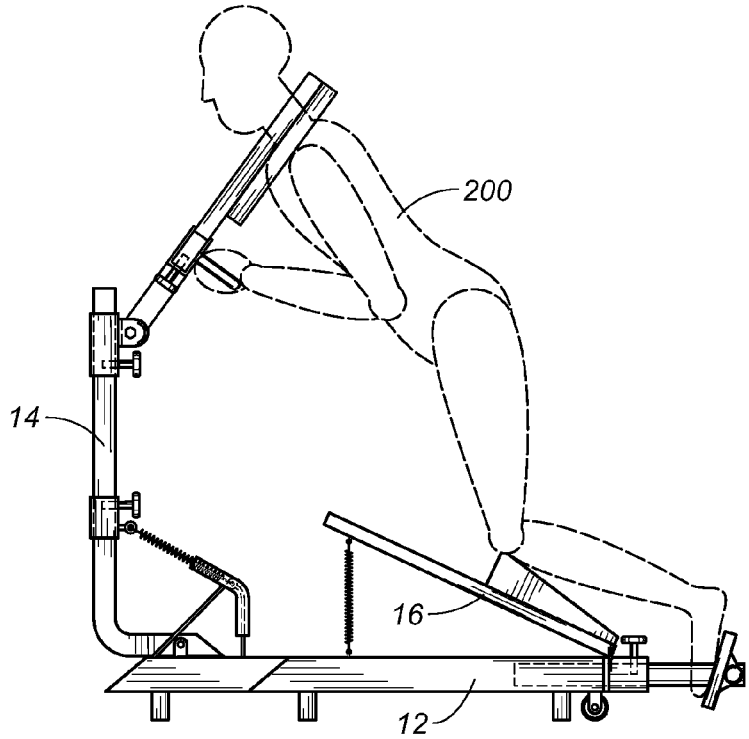
FIG. 12 is a side elevation view of the exercise device shown in a 90° knee plate-to-full extension position.

FIG. 12 shows the 90° knee plate-to-full extension position. In this position, the user 200 has his or her body fully extended. The plate is in the upward position above the base 12. The arm 14 is in its fully extended outward position. As a result, the user's body is fully extended in the position illustrated in FIG. 12.

The present invention serves to assist the portion erson 200 with physical limitations in the knee and lower extremities. The device 10 will also assist the person 200 with decreased range-of-movement. The present invention is a device which provides reasonable accommodations for an effective exercise workout. The present invention, as used in the manner illustrated in FIGS. 9-12 herein, will build and tone the muscle mass around the quads, gluts and knee regions. Additionally, the calves, the lower abs and the muscles in the lumbar will also show results. The results will vary depending upon the placement of the legs in the starting position, i.e. the knees facing straight forward or pointing slightly in or out, the legs positioned at shoulder width, or placed closer together. The plate 16 is suitably adjustable with the ability to raise and lower to the appropriate level of the person's physical mobility. The present invention also adjusts to allow those persons with no physical limitations to benefit from the workout. The present invention avoids any stress to the knee or supporting joints during the workout.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An exercise device comprising:

a base;

an arm pivotally connected to said base, said arm being resiliently interconnected to said base so as to be resistive of forward movement of said arm;

a plate pivotally connected to said base, said plate movable between a first position adjacent said base and a second position angled upwardly from said base;

a shoulder support affixed adjacent an end of said arm opposite said base, said shoulder support extending inwardly from said arm in a direction toward said plate;

a spring support extending upwardly from said base between said arm and said plate;

a spring extending from said spring support and connected to said arm, said spring providing the resilient interconnection between said arm and said base, said spring support having a housing mounted on a rod, said rod extending upwardly from said base, said housing having a vertical portion and an outwardly angled portion; and a strut having one end affixed to said housing and an opposite end connected to said base forward of said rod.

2. The device of claim 1, said arm being movable between a first position inwardly of said base and second position outwardly of said base.

3. The device of claim 1, further comprising:

a foot support connected to said base and extending outwardly of said plate on a side of said plate opposite said arm.

4. The device of claim 3, said foot support having a pair of foot plates pivotally supported thereon, said foot support being adjustably extendable toward and away from said base.

5. The device of 1, further comprising:

a bracket adjustably affixed to said arm in a location between said shoulder support and said base, said spring having one end affixed to said bracket.

6. An exercise device comprising:

a base;

an arm pivotally connected to said base, said arm being resiliently interconnected to said base so as to be resistive of forward movement of said arm;

a plate pivotally connected to said base, said plate movable between a first position adjacent said base and a second position angled upwardly from said base; and a shoulder support affixed adjacent an end of said arm opposite said base, said shoulder support extending inwardly from said arm in a direction toward said plate, said shoulder support further comprising:

a shoulder bracket adjustably affixed to an end of said arm opposite said base;

a first shoulder pad extending outwardly of said shoulder bracket in the direction toward said plate; and a second shoulder pad extending outwardly of said shoulder bracket in the direction toward said plate, said first shoulder pad being in spaced parallel relationship to said second shoulder pad.

7. The device of claim 6, said shoulder support further comprising:

a first handle extending angularly outwardly adjacent a forward end of said first shoulder pad; and a second handle extending angularly outwardly adjacent a forward end of said second shoulder pad.

8. The device of claim 6, each of said first and second shoulder pads being angularly adjustable with respect to said shoulder bracket.

9. The device of claim 6, further comprising:

a channel member affixed to said shoulder bracket and extending transverse to said arm;

a first shoulder support member adjustably received in said channel member;

a second shoulder support member adjustably received in said channel member at an end of said channel member opposite said first shoulder support member;

a first locking member connected to said channel member and said first shoulder support member; and a second locking member connected to said channel member and said first shoulder support member, said first and second locking members locking a position of said first shoulder pad relative to said second shoulder pad.

10. An exercise device comprising:

a base;

an arm pivotally connected to said base, said arm being resiliently interconnected to said base so as to be resistive of forward movement of said arm;

a plate pivotally connected to said base, said plate movable between a first position adjacent said base and a second position angled upwardly from said base;

a shoulder support affixed adjacent an end of said arm opposite said base, said shoulder support extending inwardly from said arm in a direction toward said plate, said plate being hingedly connected at an end thereof opposite said arm to said base;

a spring having one end affixed to said frame and an opposite end connected to said plate, said spring being resistive of movement of said plate from said first position to said second position; and a pad affixed to a top surface of said plate, said pad having a top surface angled upwardly from said end of said plate toward an opposite end of said plate, said plate extending beyond an end of said pad.

11. The device of claim 10, said base comprising:

a first bar;

a second bar;

at least one cross member affixed to and extending between said first bar and said second bar; and a central bar positioned in generally parallel spaced relationship between said first bar and said second bar, said arm pivotally connected to said central bar.

12. The device of claim 11, the cross member extending across an end of said first and second bars opposite the pivotal connection with said central bar, the base further comprising:

a pair of wheels affixed to said cross member and extending therebelow; and a plurality of legs extending downwardly from said first and second bars so as to support said base on an underlying surface.

* * * * *